US005382455A

United States Patent [19]

Boockmann

[11] Patent Number: 5,382,455

[45] Date of Patent: Jan. 17, 1995

[54] METHOD AND APPARATUS FOR IMPARTING A SLIDING CAPACITY TO A WIRE

[75] Inventor: Gerhard Boockmann, Sonnenstrasse 14, D-8741 Niederlauer-Unterebersbach, Germany

[73] Assignee: Gerhard Boockmann, Niederlauer-Unterebersbach, Germany

[21] Appl. No.: 106,142

[22] Filed: Aug. 12, 1993

Related U.S. Application Data

[63] Continuation of Ser. No. 831,502, Feb. 5, 1992, abandoned.

[30] Foreign Application Priority Data

Feb. 18, 1991 [DE] Germany ..... 4104897
Oct. 15, 1991 [DE] Germany ..... 4134070

[51] Int. Cl.[6] ..... B05D 1/28

[52] U.S. Cl. ..... 427/429; 427/11; 427/117; 427/120

[58] Field of Search ..... 427/11, 175, 178, 429, 427/117, 434.6, 368, 334, 120; 118/109, 106, 210, 219, 259

[56] References Cited

U.S. PATENT DOCUMENTS

| | | | |
|---|---|---|---|
| 253,227 | 2/1882 | Rice | 118/106 |
| 1,994,802 | 3/1935 | Adams | 118/109 |
| 2,328,322 | 8/1943 | Berthold . | |
| 2,386,148 | 10/1945 | Smith | 427/334 |
| 2,397,622 | 4/1946 | Rea et al. | 118/106 |
| 2,492,539 | 12/1949 | Savastone | 118/210 |
| 2,513,432 | 7/1950 | Sisson | 427/434.6 |
| 2,597,706 | 6/1952 | Couchman | 427/117 |
| 2,767,239 | 10/1956 | Kennedy | 427/117 |
| 2,840,036 | 6/1958 | Wynn | 118/257 |
| 2,985,393 | 5/1961 | Zander . | |
| 3,039,430 | 6/1962 | Papp | 118/257 |
| 3,085,547 | 4/1963 | Stobierski | 118/109 |
| 3,608,054 | 9/1971 | Alvino | 427/429 |
| 3,779,207 | 12/1973 | Benson et al. | 118/109 |
| 3,941,897 | 3/1976 | Vecchia | 427/11 |
| 4,539,228 | 9/1985 | Lazarus | 427/434.6 |
| 4,553,707 | 11/1985 | Henrich . | |

FOREIGN PATENT DOCUMENTS

| | | | |
|---|---|---|---|
| 0033040 | 8/1981 | European Pat. Off. | 118/109 |
| 140692 | 3/1980 | Germany . | |
| 3237022 | 1/1988 | Germany . | |
| 2020613 | 1/1990 | Japan | 427/178 |

*Primary Examiner*—Shrive Beck
*Assistant Examiner*—Diana Dudash
*Attorney, Agent, or Firm*—Killworth, Gottman, Hagan & Schaeff

[57] ABSTRACT

A method and apparatus are provided for imparting a sliding capacity to a wire which is fed through at least one loop of a strand of material which has been steeped in a lubricant such as paraffin or wax. Preferably, the strand of material is advanced at a speed which is less than the feed speed of the wire. The apparatus includes means for feeding the wire and means for advancing the strand of material around the wire. The apparatus also includes a compensating device which adjusts the tension of the strand of material and checking device for automatically a checking the lubricating operation.

17 Claims, 6 Drawing Sheets

1
2
3
6
7
8
10
11
12
13
14
15
16
17
18
19
20
21
22
23
24
25
26
27
28
29
30
31

METHOD AND APPARATUS FOR IMPARTING A SLIDING CAPACITY TO A WIRE

This application is a continuation of application Ser. No. 07/831,502 filed Feb. 5, 1992, now abandoned.

BACKGROUND OF THE INVENTION

It is a known fact that wires, such as electrically insulated winding wires for use in the manufacture of electric devices must have a good sliding capacity so that they can be positioned easily and accurately when windings are being manufactured. In addition, the sliding capacity of the wire should protect the electrically insulated layer during machining.

Various methods are known for imparting a sliding capacity to wires. Paraffins are predominantly used as lubricants, and they are applied as a coating in the form of solutions in benzene or other organic solvents through a felt onto the wire which is usually still warm. The solvent is vaporized, and a thin layer of paraffin remains behind on the surface of the wire. However, this method of application employs solutions with ½ to 1% proportions of paraffin, which causes high losses of solvent and thus economic losses and considerable harm to the air.

With another known method, instead of solutions of paraffin in benzene or other organic solvents, aqueous emulsions or dispersions of paraffins are used. This prevents the emission of organic solvents, but the way in which the emulsion is metered using wick or felt is problematical. A method like this is therefore unsuitable, if, as often desired, very precisely defined quantities of paraffin have to be applied to the surface of the wire. In addition, if aqueous emulsions are used, an additional drying operation is required.

All the previously known methods where the lubricant has been applied to the wire by the use of felt also have the drawback that the felt rubs off from the wires after prolonged use, and often no recognition is taken of the fact that since the felt has been rubbed off, the lubricant is only applied to one side, or not at all.

Accordingly, there is still a need in the art to overcome the drawbacks of the known methods for imparting a sliding capacity to wires, and in particular, to arrive at a method which is simple, reliable, and avoids solvent emissions.

SUMMARY OF THE INVENTION

The apparatus of the present invention comprises a means for feeding a wire, and means for advancing at least one strand of material which is wrapped around the wire and contacts it. Preferably, the speed of the advancing strand of material is slower than the feed speed of the wire.

Preferably, the means for advancing the strand of material is a metering means which meters the feed of the strand of material in a controlled manner, receives the strand of material in a controlled way, and safeguards against backlash.

In one embodiment of the invention, the means for receiving the strand of material after the lubricant has been reduced comprises a wind-up spool which is expediently driven and which draws the strand of material through the apparatus. However, it is also possible for the strand of material to be advanced by a separate means through the apparatus, and then wound up on a wind-up spool. In another embodiment, the receiving means comprises a suction device which sucks the strand from the end of the apparatus and allows the strand to accumulate.

Where the receiving means comprises a wind-up spool, it is preferred that the reel of the spool have a conical shape or be designed so that it tapers toward one end. Thus, when the strand of material is wound around it, it slips down toward the tapered end so that a coil is produced which is distributed around the entire spool without any special crossing effect.

The means for metering the supply of the strand of material in a controlled manner can vary in design and may comprise a means which brakes the wind-off device for the strand of material. Preferably, this means comprises a separate drive roller and a pressure roller which work in conjunction with each other to advance the strand of material at a uniform speed from the apparatus. Preferably, the strand of material extends so that it is taut between the advancing means and the receiving means, and is advanced to and received from the apparatus at the same speed.

A suitable means for metering the advance of the strand of material and the means for receiving the strand of material in a controlled manner are spools which are driven by a synchronous motor, i.e., by the same motor. The two spools are preferably synchronized by a drive belt which connects the rotational axes or shafts of the two spools, and which, for example, passes over a belt pulley which rests on the shaft of the spool in question.

The amount of lubricant applied to the wire may be altered by providing a drive roller which can be changed over. If the drive roller is larger in diameter, a greater amount of the strand of material is advanced per revolution so that a greater amount of lubricant is deposited on the wire per unit of its length.

In order to finely control and avoid breaks in the strand of material, it is preferred that the ratio of the metered amount to the amount received of the strand of material is controlled by the use of a compensating means. Where a synchronous motor is used as well as a drive belt which drives the wind-up spool, it is preferred that the compensating means is arranged such that the drive belt is tensioned or locked so that if the tensile stress of the strand of material increases, the compensating means loosens the drive belt, increasing slippage, so that the tensile stress of the strand of material is compensated for. When the tensile stress is reduced, the compensating means tightens the drive belt, thus reducing its slippage and increasing the tensile stress of the strand of material.

Alternatively, a second motor may be provided which compensates for the high tensile stress which may lead to breaks in the strand of material.

In a preferred embodiment of the invention, the apparatus has a braked or controlled wind-off means for the strand of material, two direction-changing rollers and a driven wind-up means, wherein the direction-changing rollers are arranged in relation to the wire in such a way that the strand of material surrounds the wire in the form of at least one loop between the two direction-changing rollers.

Preferably, an auxiliary roller is arranged on the apparatus in such a way that it changes the direction of the strand which is wrapped around the wire at least twice in contra-rotating directions. It is also preferable that the feed means for the wire impart a linear movement to the wire in the region between the direction-changing rollers.

Means are also provided for controlling the feed rate of the wire and/or the rate of advancement of the strand of material. The wind-up spool is preferably driven at a constant winding traction. The wind-off spool or a means disposed downstream thereof preferably has a certain resistance to coiling and/or a specific wind-off speed.

Since malfunctions can occur during operation of the apparatus, the apparatus is provided with a special checking means which comprises a direction-changing means movable between two end positions. The direction changing means can be drawn by the strand of material into a first end position and can be moved to a second end position by the force of a spring. A signal transmitter device emits a signal when the direction-changing means moves to the second end position. The checking means emits a signal when the strand of material tears, when the operator has forgotten to insert a new strand of material, when the tensioning of the strand of material is too little, when the drive motor is faulty, or when the feed spool for the strand of material is at an end. Preferably, the direction-changing means is disposed between the direction-changing rollers and near the wire. The direction-changing means comprises a roller or a mandrel over which the strand of material is drawn. Preferably, the means is arranged on a lever arm which is pivotable about an axis and which is prestressed by a spring. The means can be designed in a such a way that it closes an electrical contact in a first end position, which contact, on opening, triggers a signal.

Under normal conditions, the strand of material draws the direction-changing means counter to the tensioning of the spring toward the electrical contact. Thus, if the tensioning of the strand of material is reduced or stopped, the direction-changing means is lifted from the electrical contact by spring force and passes to the second end position where a visual or audible signal is emitted.

In practice, it is customary to coat a larger number of wires with a wire lacquer, where the wires leave the lacquering installation at relatively short distances apart. If the lubricant-applicator means is to be directly connected, one such applicator means must be provided for each wire which leaves the lacquering installation. This causes certain problems in terms of the space requirement needed because the applicator means is usually wider than the distance between the wires leaving the lacquering installation. In order to overcome this problem, it is preferable if the direction-changing rollers for the strand of material are secured to a tongue portion which is pivotally attached to the apparatus, where the tongue portion is pivotable or displaceable horizontally and/or vertically. Thus, a pivotal movement can be made to reduce the distance between the parallel wires passing through the lubricant coating installation.

The method according to the invention for imparting a sliding capacity to a wire comprises the steps of providing a wire moving in a linear direction and guiding the wire through at least one loop resting on the wire comprising a strand of material which has been steeped in a lubricant such that the wire becomes coated with the lubricant. Preferably, the strand of material is advanced at a speed which is slower than the feed speed of the wire. The feed speed of the wire is produced by pushing or drawing the wire.

Any material can be used for the absorbent strand of material which is wrapped around the wire. Preferably, the material should be strong enough to withstand tearing when being advanced. The strand of material is selected from the group consisting of yarn, twine, or thread. The strand of material preferably comprises pure cotton threads, although any absorbent textile materials may be used. The strand of material is wound around the wire at least once, but more preferably several times. It is also possible for two or more loops of material to be wrapped around the wire in succession to provide a more dense arrangement of loops. Preferably, the yarns or twines are 30 to 300 g/km in weight.

Liquid or solid substances with sliding properties are suitable for use as lubricants. However, solid lubricants are preferred at ambient temperatures since they provide a better sliding effect. The lubricant may be selected from the group consisting of paraffins, oils, fats and waxes, with paraffins being the preferred lubricant. Any of the suitable lubricants may be mixed with a wetting agent such as a fluorine-containing wetting agent to improve the wetting surface of the wire. A suitable lubricant may comprise 98 parts by weight of a paraffin with a melting range of 50° to 54° C. and 2 parts by weight of a commercially available fluorine-containing wetting agent.

Waxes are also preferred for use as lubricants because of their high melting point. For example, waxes such as beeswax or carnuba wax improve the sliding capacity more than relatively low-melting paraffins.

The steeping quantity of the absorbent strand of material can be varied at random. The quantity of lubricant impregnated in the yarn or twine can be in the order of approximately 100% of the inherent weight of the yarn or twine. The amount of lubricant applied to the wire may be controlled by the amount of lubricant in the absorbent strand of material as well as the temperature of the wire. Alternatively, the amount of lubricant applied to the wire may be controlled by the number of times that the strand of material is wound around the wire. In another alternative, the amount applied to the wire is controlled by the relationship between the advancing speed of the strand of material and the feed speed of the wire.

It is often sufficient for application of the lubricant to a wire to rub off the lubricant onto the wire as it is fed through one or more loops of the steeped strand of material. However, it is preferable for the wire to be fed through the loops of the strand of material at an increased temperature, and to use a lubricant which melts at the temperature of the wire. In this way, the lubricant is applied as a uniform coating of molten lubricant to the surface of the wire. Preferably, in the region of the loops, the temperature of the wire is between the melting temperature of the lubricant and 200° C.

It is preferred that the feed speed of the wire is much greater than that of the strand of material steeped with the lubricant. The preferred feed ratio of the strand of material and wire is in the range of 1:100 to 1:10,000.

The lubricant is preferably applied to the surface of the wire at a thickness of between 2 and 100 mg/m$^2$ and more preferably between 20 and 100 mg/m$^2$. A thin application such as this is particularly easy if a lubricant is used which has a melting point in the range of 35° to 140° C. and if the wire is drawn through the loops of the strand of material at an increased temperature. Generally, the wire emerges from a preceding process at an increased temperature, so it is preferable to make use of the increased temperature and directly coat it with lubricant.

In one embodiment of the invention, the loop around the wire comprises a strand of material which has been previously impregnated with a lubricant. In another embodiment of the invention, the strand of material is steeped just prior to making contact with the wire by guiding the strand of material through a bath of molten or liquid lubricant and then guiding the material through a stripper device. In this embodiment, a continuously spiralling strand of material is used which is guided in a closed circuit through the lubricant steeping device and over the wire.

The strand of material is preferably guided against the flow of the feed of the wire, but may also be guided with the flow of the wire.

The method and apparatus of the present invention makes it possible for wires to be given a sliding capacity with no emission of solvents into the air. A particular advantage of the method and apparatus according to the present invention is the fact that by controlling the advancing strand of material, it is possible to automatically and continuously check whether lubricant is actually being fed to the wire upon which a sliding capacity is to be imparted. The method can therefore be used particularly advantageously for fully automatic and unsupervised production of electrical winding wires. Also, if increased drawing of the wire is established, this will indicate that the wire has been imparted with a disturbing roughness during the preceding lacquering process. An appropriate signal can be used therein to correct the lacquering process.

This, and other objects and advantages of the present invention will become apparent from the following detailed description, the accompanying drawings, and the appended claims.

DETAILED DESCRIPTION OF THE PREFERRED EMBODIMENT

Figure 1:
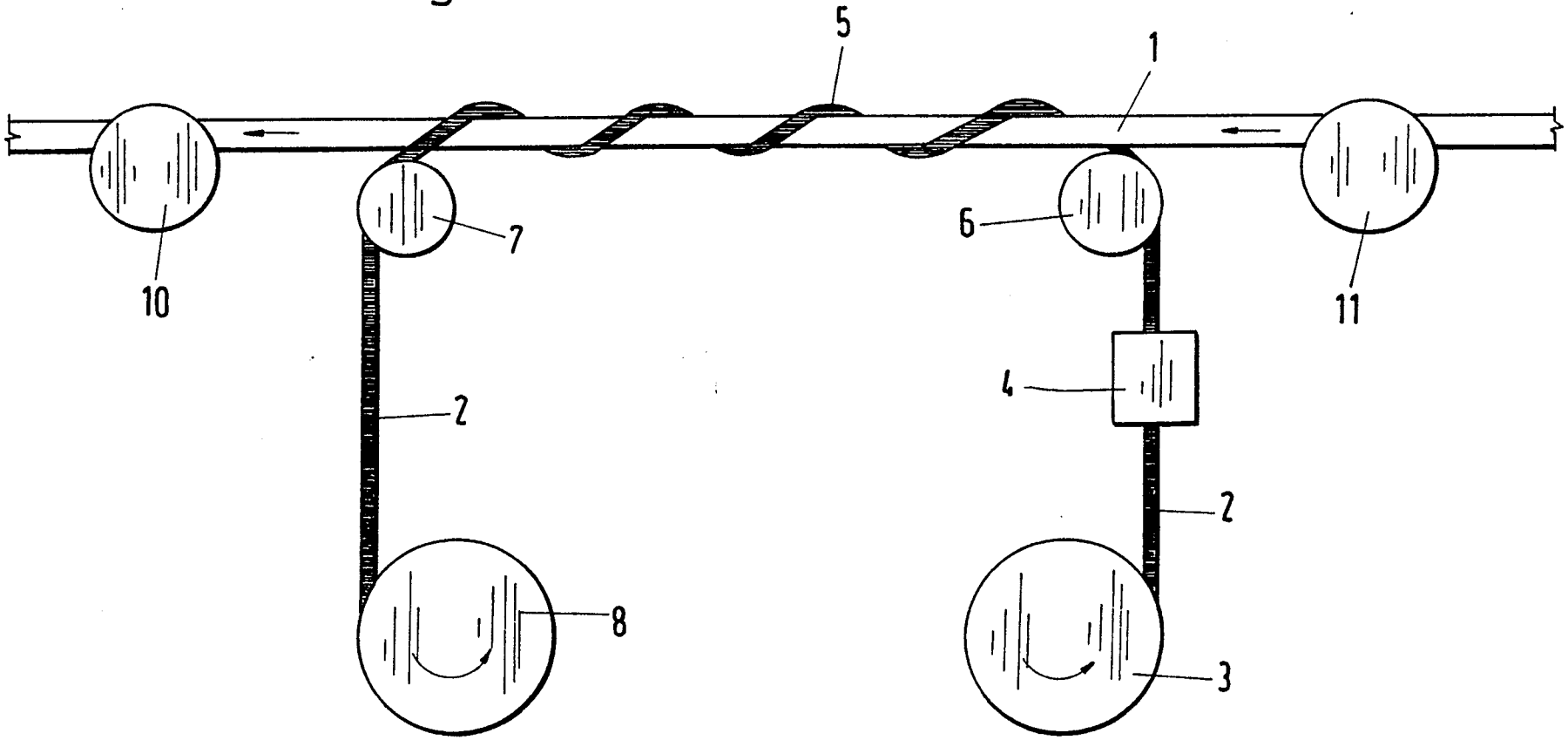
FIG. 1 shows a first embodiment of the invention.

As shown in FIG. 1, the wire 1 is fed in the direction of the arrow from a feeding means, not shown, in linear fashion from right to left over the rollers 10 and 11 through four loops 5 of a strand of material 2 which has been steeped or immersed in lubricant. The strand of material 2 is unwound from a braked wind-off means which gives a specific resistance to coiling. The strand of material 2 is unwound and guided by a tension measuring means 4 and a direction-changing roller 6 in coils around the wire 1 to the direction-changing roller 7 and to the driven wind-up means 8.

Figure 2:
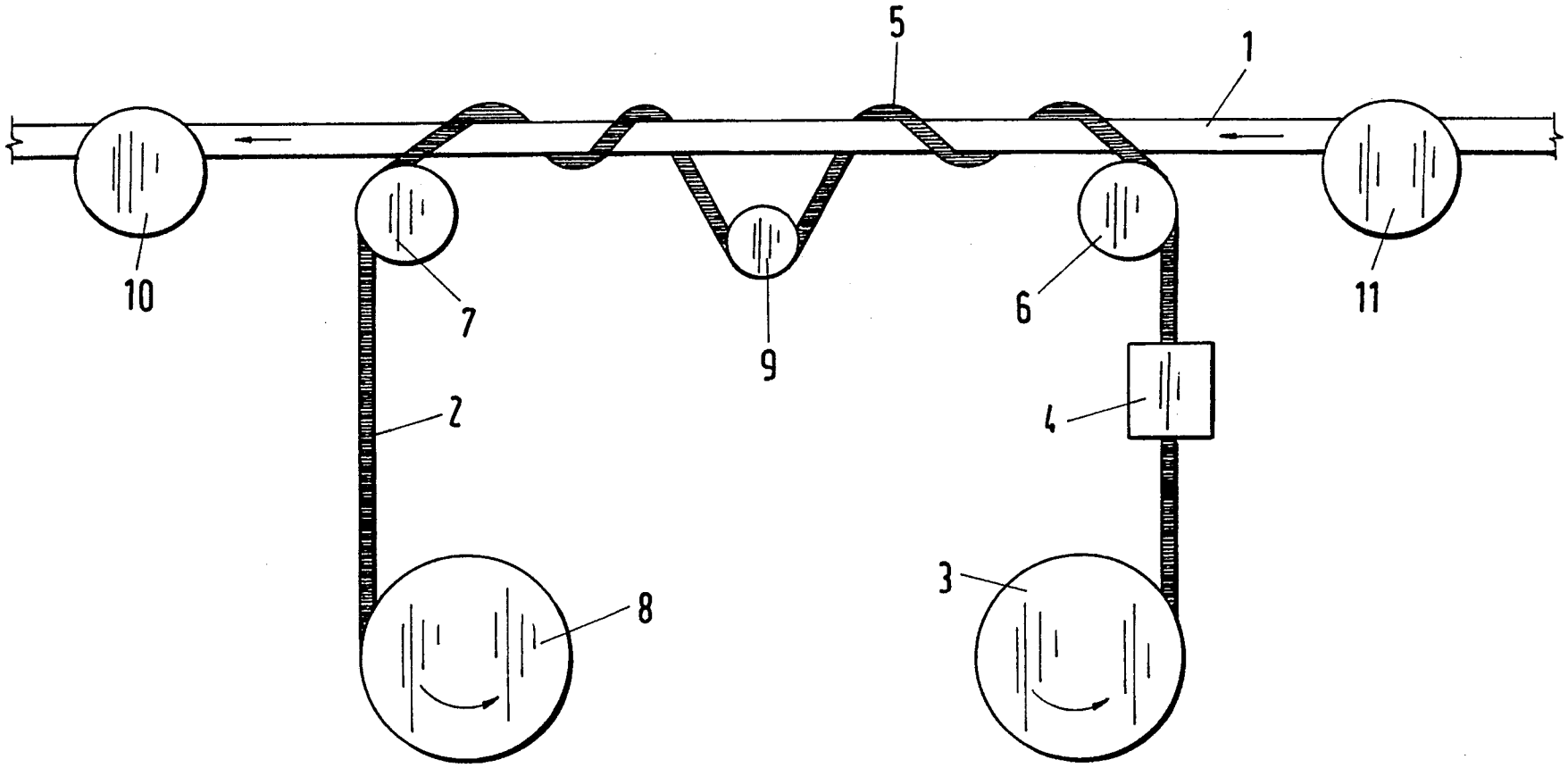
FIG. 2 shows a second embodiment of the method according to the invention.

FIG. 2 illustrates another embodiment of the invention in which an additional auxiliary roller 9 is provided between the direction-changing rollers 6 and 7. The auxiliary roller 9 enables the strand of material 2 to be wrapped around the wire in contra-rotating fashion.

In FIGS. 3–6, a housing 14 with a downwardly projecting carrier 13 and a tongue portion 27, which is pivotally attached to the carrier 13 are arranged on a console 12. The supply spool or wind-off spool 3 for a strand of material 2 impregnated with lubricant is rotatably mounted on the console 12. The strand of material 2 extending from the spool 3 passes around a shaft 15 and direction-changing rollers 39 and 16, before passing repeatedly about guide roller 17 and drive roller 18. A pressure roller 19 is pressed against the strand of material 2 which is wrapped twice around the drive roller 18. The strand of material passes from the drive roller 18 over direction-changing rollers 22, 6, 7, 28, 26, 23 and 25 to the wind-up spool 8 with a conically tapered reel 31. In the region between the direction-changing rollers 6 and 7, the strand of material 2 is wrapped around the wire 1 which is guided over the support rollers 11 and 10 and moves in the same directions as the wire 1. The strand of material passes over the direction-changing mandrel 29 approximately in the center between the direction-changing rollers 6 and 7.

The tongue portion 27 is pivotable horizontally and vertically, for example, through 180° horizontally and 15° vertically. The vertical pivotal movements can be made by using a fixing screw 30 in a slot.

Figure 4:
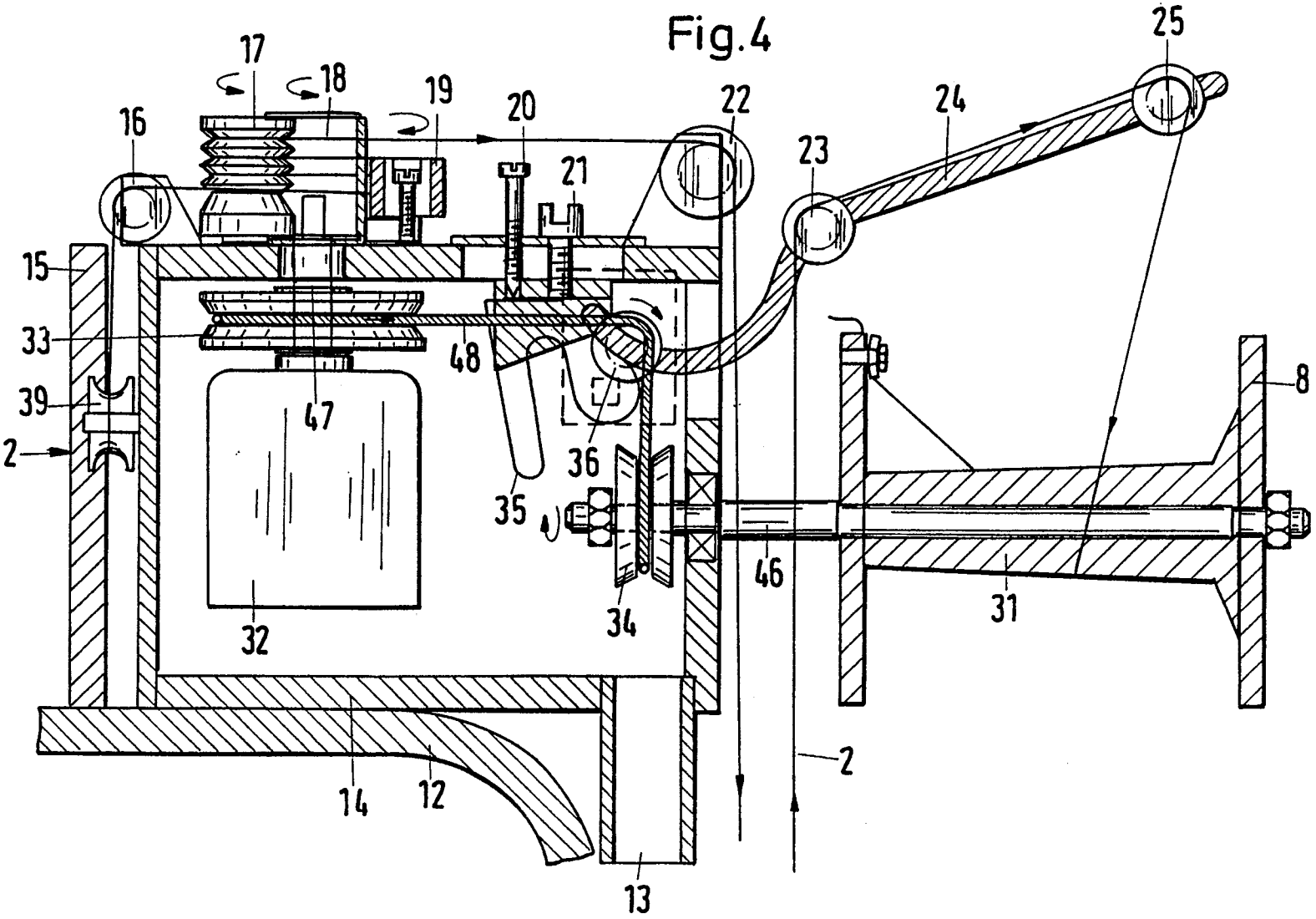
FIG. 4 shows is a side view, partially in section, showing the upper drive region of the apparatus shown in FIG. 3.
Figure 5:
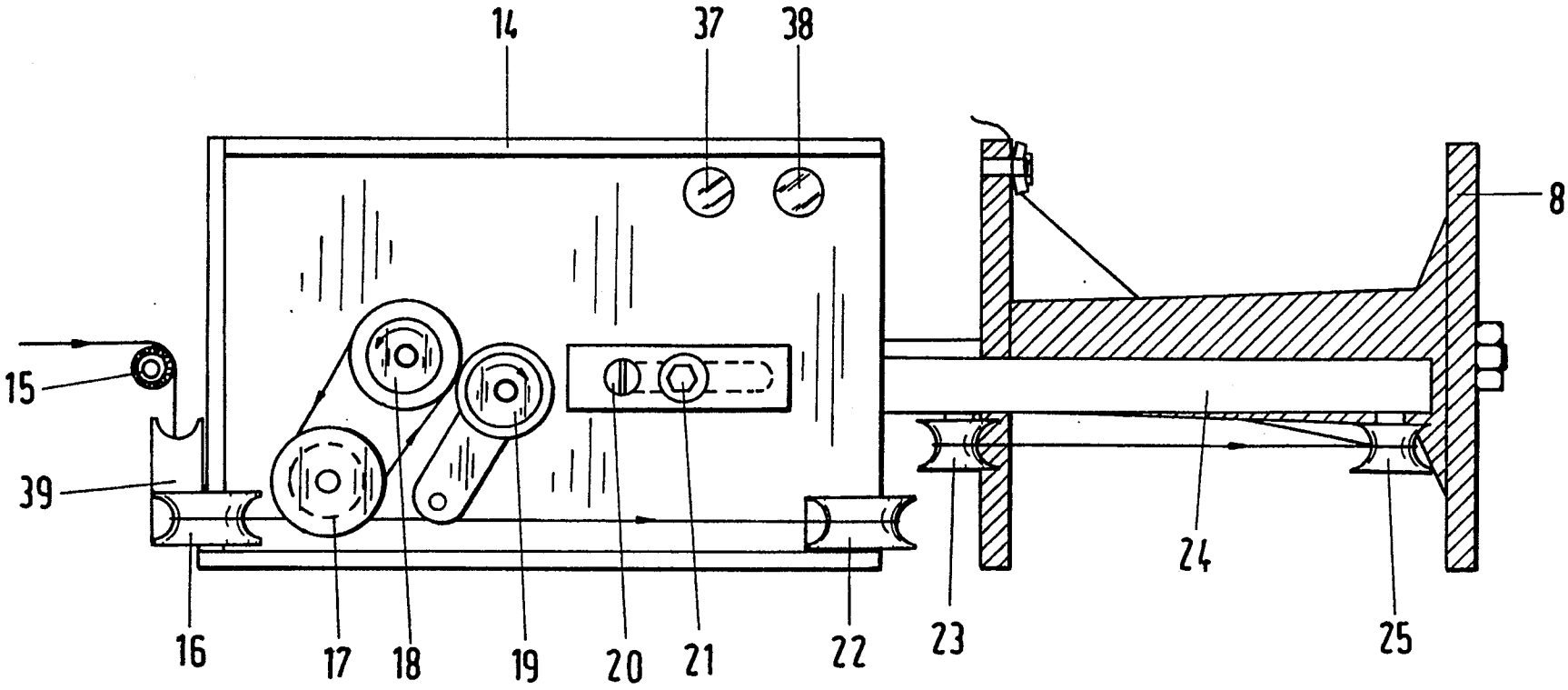
FIG. 5 is a plan view of the region of the apparatus shown in FIG. 4.

As can be seen in FIG. 4, the housing 14 contains a synchronous motor 32 which drives the exchangeable drive roller 18 by means of a shaft 47, which drive roller 18 meters the supply of the strand of materials. Secured to the shaft 47 is a belt pulley 33 over which a belt 48 passes via the direction-changing roller 36 to the belt pulley 34 on the shaft 46 of the wind-up spool 8. The belt 48 rotates the wind-up spool 8 at the same speed that the synchronous motor 32 drives the drive roller 18. A screw 21 can be used to adjust the tensioning of the belt.

In order to compensate for undesirably high tensioning in the strand of material 2, compensating means 24 is used which is prestressed in its normal position by spring 35. The adjusting screw 20 can be used to adjust the tensioning of the spring.

If the tensioning of the strand of material a is too great, the end of the compensating means 24 is drawn under with the direction-changing roller 25, wherein the lever arm of the compensating means 24 draws the direction-changing roller 36 for the drive belt 48 against the tensioning by the spring 35 underneath as well, whereby slippage of the drive belt 48 is increased, and the excessive tensioning of the spring is compensated for.

Figure 6:
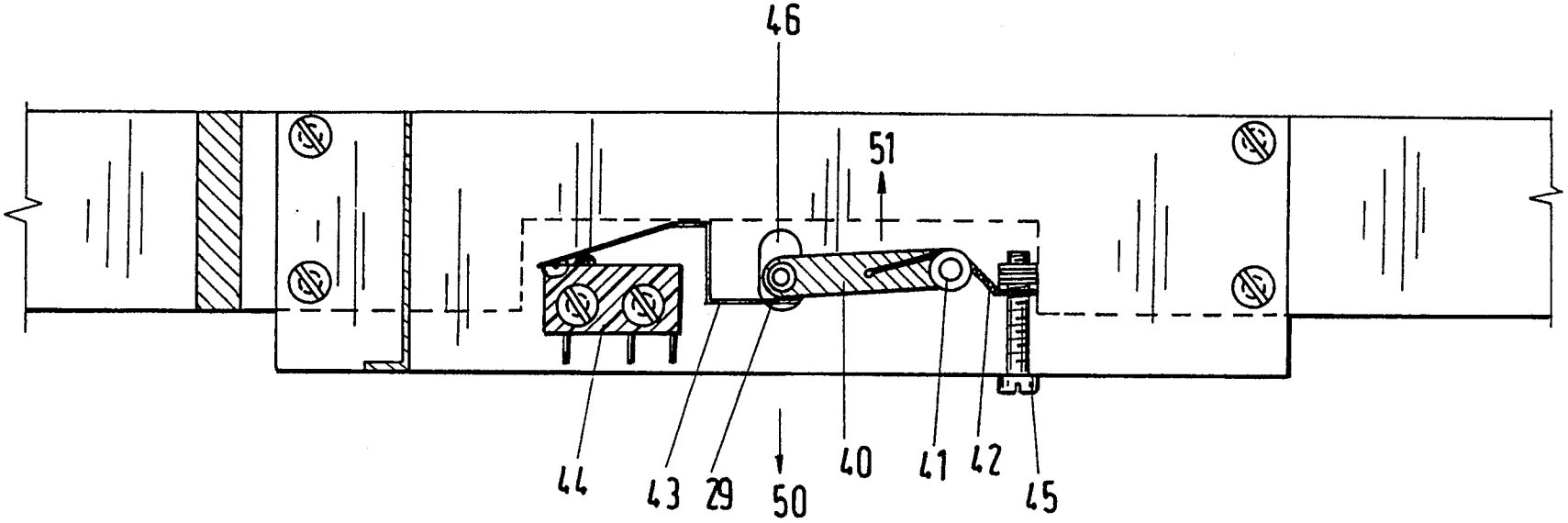
FIG. 6 shows an enlarged view partially in section of the central section of the tongue portion of the apparatus shown in FIG. 3.

As can be seen particularly well in FIG. 6, the direction-changing mandrel 29 in the region of the tongue portion 27 is secured to a mandrel lever 40 which is pivotable about an axis of rotation 41. The mandrel lever 40 is prestressed in the upward direction by means of the spring 42. This prestressing can be adjusted by the use of the adjusting screw 45.

Figure 3:
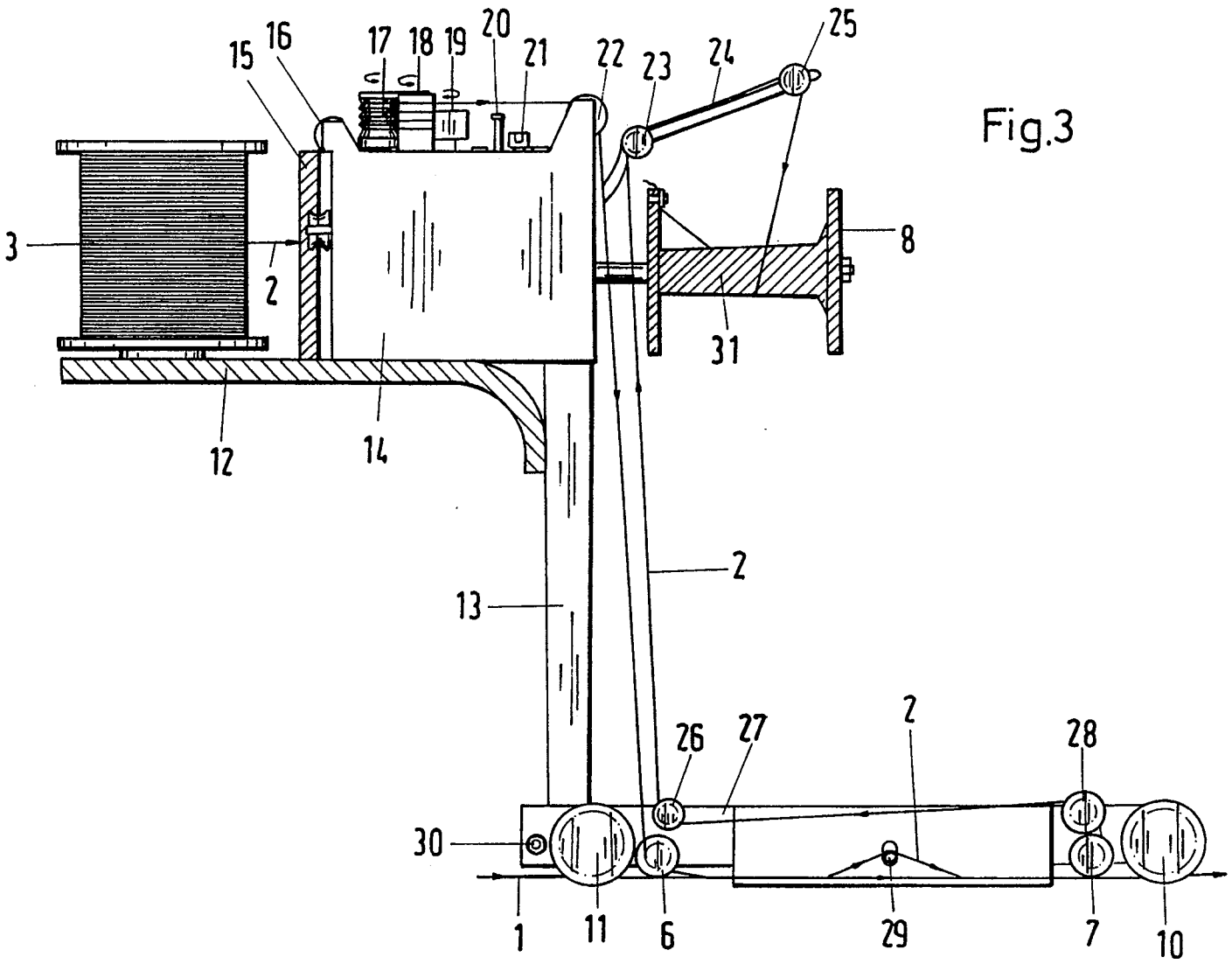
FIG. 3 shows a side view of an embodiment of the apparatus according to the invention.

By pivoting the mandrel lever 40 it is possible to move the direction-changing mandrel 29 in the slot 46 from the bottom end position shown in FIG. 6 to an upper end position (now shown). In the bottom end position shown in FIG. 6, the mandrel lever 40 is disposed on the actuating lever 43 of a microswitch 44, and it closes an electrical contact therein. This bottom end position is adopted by the direction-changing mandrel 29 when it is drawn in the direction of the arrow 50 by the strand of material 2 in the normal operative position if the strand of material as shown in FIG. 3 passes over the direction-changing mandrel. If the strand of material tears or if the tensioning of the strand of material is too low, the direction-changing mandrel 29 is pushed up in the slot 46 in the direction of the arrow 51 beneath the force of the spring 42, wherein the electrical contact is interrupted which triggers a signal visible in the form of signal lights 37 or 38 in FIG. 5, for example.

In order that the invention may be more readily understood, reference is made to the following examples, which are intended to be illustrative of the invention, but are not intended to be limiting in scope.

EXAMPLE 1

An electrical winding wire with a diameter of 0.3 mm and a 40 μm thick polyimide lacquering was issued from the lacquering installation downstream of a lacquering and drying device with a surface temperature of 200° C. In front of the wind-off means, which was 4 m away from the discharge end of the oven, the wire still had a surface temperature of 60° C. The wire was fed at 100 m/min. An advancing means was used to advance the strand of material which was steeped in a lubricant at a speed of 0.1 m/min. with the winding wire being encircled four times by the strand of material in the direction opposite that in which the wire was being fed. The tensioning of the strand of material was set to 10 g. The strand of material comprised a cotton twine with 40 g/km (40 tex) strength and a lubricant content of 35 to 45 g/km. The lubricant comprised 98% of a paraffin having a melting point of 50° to 54° C. and 2% wetting agent (FC 170). The twine was steeped, cooled and wound up by being dipped and stripped by a rubber nozzle. The means for advancing the strand of material was installed 0.5 m in front of the wire feeding means.

EXAMPLE 2

An electric winding wire which was 0.58 mm in diameter and having a 40 μm thick polyimide lacquering was issued from the lacquering and drying installation downstream of the lacquering and drying means with a surface temperature of 200° C. Upstream of the feeding means, which was 4 m away from the discharge of the oven, the wire had a surface temperature of 60° C. The wire was fed at a rate of 40 m/min. By using an advancing means for the strand of material as described in the drawings, a strand of material which was steeped in lubricant was encircled four times around the wire, and was advanced continuously at a rate of 0.063 m/min in the direction in which the wire was being fed. The tensioning of the strand of material was set to 50 g. The strand of material was a cotton twine with 45 g/km (45 tex) strength and a lubricant content of 75 g/km. The lubricant used was beeswax. The twine was steeped, cooled and wound up by being dipped and stripped using a rubber nozzle. The advancing means for the strand of material was installed 2 m behind the exit from the drying oven.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A method for imparting a sliding capacity to a wire comprising the steps of:

providing a strand of material coated with a lubricant;

guiding said wire through at least one loop of said strand of material;

advancing said strand of material along a path at a first speed;

advancing said wire through said loop at a second speed which is greater than said first speed such that said wire contacts said loop and receives a substantially continuous coating of said lubricant over its entire outer surface, wherein between about 2 $mg/m^2$ and 1000 $mg/m^2$ of lubricant is applied to said wire.

2. A method for imparting a sliding capacity to a wire as set forth in claim 1, wherein said strand of material is selected from the group consisting of yarn, twine and thread.

3. A method for imparting a sliding capacity to a wire as set forth in claim 1, wherein said strand of material comprises cotton.

4. A method for imparting a sliding capacity to a wire as set forth in claim 1, wherein said lubricant is selected from the group consisting of paraffin, oil and fat.

5. A method for imparting a sliding capacity to a wire as set forth in claim 1, wherein the ratio of the first speed to the second speed is in the range of about 1:100 to 1:10,000.

6. A method for imparting a sliding capacity to a wire as set forth in claim 1, wherein said lubricant has a melting point of between about 35° C. and 140° C.

7. A method for imparting a sliding capacity to a wire as set forth in claim 1, wherein said wire is advanced through said loop at a temperature of between about 35° C. to 200° C.

8. A method for imparting a sliding capacity to a wire as set forth in claim 1, wherein said lubricant is mixed with a wetting agent.

9. A method for imparting a sliding capacity to a wire as set forth in claim 1, further comprising the step of controlling the amount of lubricant coated on said wire by controlling said first speed.

10. A method for imparting a sliding capacity to a wire as set forth in claim 1, further comprising the step of controlling the amount of lubricant coated on said wire by controlling said second speed.

11. A method for imparting a sliding capacity to a wire as set forth in claim 1, wherein between about 20 mg and 100 mg of lubricant is applied to 1 $m^2$ of surface area of said wire.

12. A method for imparting a sliding capacity to a wire as set forth in claim 1, wherein said step of providing a strand of material which has been coated with a lubricant comprises the step of providing a strand of material which has been immersed in a bath of lubricant.

13. A method for imparting a sliding capacity to a wire as set forth in claim 1, wherein said strand of material is wound in a plurality of loops about said wire.

14. A method for imparting a sliding capacity to a wire as set forth in claim 13, wherein each of said loops is wound in the same direction about said wire.

15. A method for imparting a sliding capacity to a wire as set forth in claim 13, wherein at least two of said loops are wound in contra-rotating directions about said wire.

16. A method for imparting a sliding capacity to a wire comprising the steps of:

providing a strand of material coated with a lubricant;

guiding said wire through at least one loop of said strand of material;

advancing said strand of material along a path at a first speed;

advancing said wire through said loop at a second speed which differs from said first speed such that said wire contacts said loop and receives a substantially continuous coating of said lubricant over its entire outer surface, wherein between about 2 $mg/m^2$ and 1000 $mg/m^2$ of lubricant is applied to said wire.

17. A method for imparting a sliding capacity to a wire as set forth in claim 1, wherein said lubricant is selected from the group consisting of wax, oil and fat.

* * * * *